US011351650B2

(12) United States Patent
Daimaru et al.

(10) Patent No.: US 11,351,650 B2
(45) Date of Patent: Jun. 7, 2022

(54) SPECTACLE LENS MANUFACTURING METHOD

(71) Applicant: HOYA LENS THAILAND LTD., Pathumthani (TH)

(72) Inventors: Takashi Daimaru, Tokyo (JP); Hidetoshi Nishimura, Tokyo (JP); Takao Tanaka, Tokyo (JP)

(73) Assignee: HOYA LENS THAILAND LTD., Pathumthani (TH)

( * ) Notice: Subject to any disclaimer, the term of this patent is extended or adjusted under 35 U.S.C. 154(b) by 254 days.

(21) Appl. No.: 16/446,144

(22) Filed: Jun. 19, 2019

(65) Prior Publication Data

US 2019/0299355 A1 Oct. 3, 2019

Related U.S. Application Data

(62) Division of application No. 15/108,520, filed as application No. PCT/JP2014/084307 on Dec. 25, 2014, now Pat. No. 10,549,398.

(30) Foreign Application Priority Data

Dec. 26, 2013 (JP) ..... 2013-270087

(51) Int. Cl.
*B24B 13/005* (2006.01)
*B24B 9/14* (2006.01)
*B24B 13/00* (2006.01)

(52) U.S. Cl.
CPC ..... *B24B 9/146* (2013.01); *B24B 13/00* (2013.01); *B24B 13/005* (2013.01)

(58) Field of Classification Search
CPC ..... B24B 9/146; B24B 13/005; B24B 47/225
See application file for complete search history.

(56) References Cited

U.S. PATENT DOCUMENTS 8,209,046 B2 * 6/2012 Brechemier ..... B24B 9/146 700/117
2001/0055111 A1 12/2001 Yoda et al.
(Continued)

FOREIGN PATENT DOCUMENTS

DE 3829488 A1 3/1990
EP 1093907 A2 4/2001
(Continued)

OTHER PUBLICATIONS

Mar. 17, 2015 International Search Report issued in International Patent Application No. PCT/JP2014/084307.
(Continued)

*Primary Examiner* — Rick K Chang
(74) *Attorney, Agent, or Firm* — Oliff PLC

(57) ABSTRACT

Provided is a block device that mounts a lens shape processing lens holder to a convex surface of a spectacle lens with two alignment reference marks for identifying a distance portion design reference point on a concave surface. The block device includes an imaging unit that images the alignment reference marks of the spectacle lens supported by a support unit from a convex surface side of the spectacle lens, an information processing unit that obtains expected imaged positions of the alignment reference marks imaged by the imaging unit, using information regarding the spectacle lens, when a posture of the spectacle lens supported by the support unit becomes a reference posture suitable for mounting the lens holder, and a display control unit that displays images of index marks indicating the expected imaged positions obtained in the information processing unit and images of the alignment reference marks.

7 Claims, 11 Drawing Sheets

(56) References Cited

U.S. PATENT DOCUMENTS

| | | | | |
|---|---|---|---|---|
| 2003/0107704 | A1 | 6/2003 | Senda et al. | |
| 2008/0231794 | A1 | 9/2008 | Yanagi et al. | |
| 2009/0301654 | A1* | 12/2009 | Suzuki | B32B 27/32 156/332 |
| 2018/0157061 | A1* | 6/2018 | Kikuchi | G02C 7/061 |

FOREIGN PATENT DOCUMENTS

| | | | |
|---|---|---|---|
| JP | H08-297262 | A | 11/1996 |
| JP | 2000-258732 | A | 9/2000 |
| JP | 2002-001638 | A | 1/2002 |
| JP | 2003-131175 | A | 5/2003 |
| JP | 2003-131176 | A | 5/2003 |
| JP | 2005-316436 | A | 11/2005 |
| WO | 2004/062848 | A1 | 7/2004 |
| WO | 2013/087504 | A1 | 6/2013 |

OTHER PUBLICATIONS

Aug. 11, 2017 Search Report issued in European Patent Application No. 14873949.3.
Sep. 14, 2017 Office Action issued in Australian Patent Application No. 2014371019.
Jun. 1, 2018 Office Action issued in Chinese Patent Application No. 201480070926.6.

* cited by examiner

SPECTACLE LENS MANUFACTURING METHOD

CROSS-REFERENCE TO RELATED APPLICATION(S)

This application is a divisional of U.S. application Ser. No. 15/108,520 filed Jun. 27, 2016, which is a national stage of International Patent Application No. PCT/JP2014/084307 filed on Dec. 25, 2014 and claims priority under 35 U.S.C. 119 from Japanese Patent Application No. 2013-270087 filed on Dec. 26, 2013. The contents of the above applications are incorporated herein by reference in their entirety.

TECHNICAL FIELD

The present invention relates to a block device that mounts a lens shape processing lens holder to a spectacle lens, a spectacle lens manufacturing method including a block process therefor, and a program.

BACKGROUND ART

Typically, there are spectacle lenses having an alignment reference mark formed to identify a distance portion design reference point (hereinafter, simply referred to as "design reference point") defined in a JIS standard (JIS T 7330). An example of this type of spectacle lens includes a progressive power spectacle lens. In a case of the progressive power spectacle lens, power distribution is more complicated than a single focus lens and the like. Therefore, it is difficult to precisely identify the design reference point with a lens meter or the like after finishing processing of a lens surface is completed. Further, the design reference point is close to a position where a gaze passes through when a wearer of the spectacle views a distant point and thus if the alignment reference mark is formed on the design reference point, the alignment reference mark becomes an obstacle of the distant view. Further, a horizontal axis (an axis in a direction of 0 to 180 degrees) and a vertical axis (an axis in a direction of 90 to 270 degrees) are set to the progressive power spectacle lens centering around the design reference point. Therefore, the design reference point cannot be identified with only one alignment reference mark. Therefore, two alignment reference marks are formed on the progressive power spectacle lens with equal spaces from the design reference point to the right and left (in the horizontal axis direction). Providing the two alignment reference marks on the progressive power lens is defined in a JIS standard (JIS T 7315).

Conventionally, a lens called semi-finished lens is typically used, in which an object side surface (convex surface side) of a progressive power spectacle lens is a progressive surface and the convex surface side is optically finished. Therefore, a polishing jig is mounted on the convex surface of the semi-finished lens, and a concave surface is finished to have a desired surface shape.

Meanwhile, a spectacle lens that has undergone the above finishing processing and have both surfaces become final optical surfaces (hereinafter, the spectacle lens is also referred to as "uncut lens") undergoes lens shape processing to be finally fit into a spectacle frame. To perform the lens shape processing, a lens shape processing lens holder is mounted to the spectacle lens, using the alignment reference marks on the spectacle lens as references, in a block process that is a preprocess of the lens shape processing. To be specific, a center position (hereinafter, referred to as "holder mounting center position") where the lens holder should be mounted on the convex surface of the spectacle lens is determined, and the lens holder is mounted to the holder mounting center position. At that time, the holder mounting center position is determined by visually recognizing (imaging) the alignment reference marks from the convex surface side of the spectacle lens. Further, in the lens shape processing process thereafter, the spectacle lens to which the lens holder has been mounted is set to a lens shape processor, and then the lens shape processing (including edge grinding processing, lens edging processing, and the like) is performed using a processing tool included in the lens shape processor, so that a lens that has undergone the lens shape processing is completed.

Conventionally, as a technology of determining the holder mounting center position using the alignment reference marks, a technology described in Patent Literature 1 is known, for example. This conventional technology determines the holder mounting center position by imaging the alignment reference marks formed on one lens surface of the spectacle lens from a side of the lens surface where the alignment reference marks are formed, using two imaging units.

CITATION LIST

Patent Literature

Patent Literature 1: JP 2005-316436 A

SUMMARY OF INVENTION

Technical Problem

By the way, in recent years, spectacle lenses with free curved surface design in which both surfaces of the lens are polished have been on sale. Along with that, spectacle lenses with the alignment reference marks formed on a concave surface, instead of a convex surface, have been manufactured.

Meanwhile, a block device used to mount the lens holder to the spectacle lens (uncut lens) before the lens shape processing has a specification in which the alignment reference marks affixed on the concave surface of the lens are directly recognized (imaged) from a side of the convex surface, and the holder mounting center position is determined based on the positions of the alignment reference marks.

Therefore, under existing circumstances, marks are added to the convex surface side of the spectacle lens later in accordance with the specification of the block device. To be specific, an operator picks up the spectacle lens, holds the spectacle lens over a fluorescent lamp or the like, visually recognizes the alignment reference marks affixed on the concave surface of the lens from the convex surface side, and provides marks on the convex surface of the lens with a marker or the like in accordance with the positions of the alignment reference marks. Then, in the block device, an intermediate point of the right and left marks is assumed as the design reference point, using the marks provided by the operator, for example, and the holder mounting center position is determined based on the intermediate point and the lens holder is mounted.

However, in such a technique, the marked positions have deviation due to a parallax, a power of the lens, and the like. That is, the direction of the alignment reference mark viewed by the operator, when the spectacle lens is marked, slightly differs every time or depending on the operator. If so, the positions of the alignment reference marks actually recognized by the operator through the spectacle lens and the positions of the marks affixed in accordance with the positions of the alignment reference marks have deviation. As a result, the lens holder is mounted to a position deviating from a position where the lens holder is supposed to be mounted. If such deviation is caused in the mounting position of the lens holder, PD deviation (pupillary distance) occurs when the spectacle lens that has undergone the lens shape processing using the lens holder is fit into the spectacle frame.

As a method of avoiding occurrence of the PD deviation, a method of imaging the alignment reference marks affixed on the concave surface of the lens from the concave surface side in the block device can be considered. However, this method is not practical for the following reasons. That is, in a manufacturing site of the spectacle lens, an extremely large number of types of lenses is treated. Therefore, processing in which the operator judges the surface with the alignment reference marks, for each lens, from the large number of types of lenses, and uses a different block device depending on the type, increases a burden on the operator, and a larger number of devices than the number of products needs to be prepared. Therefore, the above-mentioned method is not practical.

A principal object of the present invention is to provide a technology that can highly precisely mount a lens shape processing lens holder to a convex surface of a spectacle lens with alignment reference marks formed on a concave surface.

Solution to Problem

According to a first aspect of the present invention, there is provided a block device that mounts a lens shape processing lens holder to a convex surface of a spectacle lens with two alignment reference marks for identifying a distance portion design reference point formed on a concave surface, the block device including:

a support unit configured to support the spectacle lens in a position adjustable manner;

an imaging unit configured to image the alignment reference marks of the spectacle lens supported by the support unit from a convex surface side of the spectacle lens;

a monitor configured to display an image;

an information processing unit configured to obtain expected imaged positions of the alignment reference marks imaged by the imaging unit, using information regarding the spectacle lens, when a posture of the spectacle lens supported by the support unit becomes a reference posture suitable for mounting the lens holder; and a display control unit configured to display, on the monitor, images of index marks indicating the expected imaged positions obtained in the information processing unit and images of the alignment reference marks actually imaged by the imaging unit.

According to a second aspect of the present invention, there is provided the block device according to the first aspect, wherein the information regarding the spectacle lens includes an eccentric amount of a center position where the lens holder is to be mounted, with respect to the distance portion design reference point, and the information processing unit individually obtains the expected imaged position of one alignment reference mark and the expected imaged position of the other alignment reference mark, of the two alignment reference marks, according to the eccentric amount.

According to a third aspect of the present invention, there is provided the block device according to the first or second aspect, wherein the support unit supports the spectacle lens by receiving the convex surface of the spectacle lens at three points from below, and the images of the index marks and the images of the alignment reference marks are displayed on the monitor, when the position of the spectacle lens supported by the support unit is adjusted.

According to a fourth aspect of the present invention, there is provided the block device according to any one of the first to third aspects, wherein the reference posture of the spectacle lens is a state in which a normal vector of a center position where the lens holder is to be mounted, in the convex surface of the spectacle lens, becomes parallel to an optical axis of an optical system of the imaging unit, and the two alignment reference marks become horizontal, and the posture of the spectacle lens in the support unit becomes the reference posture, when the images of the alignment reference marks are positioned to the images of the index marks on the monitor.

According to a fifth aspect of the present invention, there is provided a spectacle lens manufacturing method including a block process of mounting a lens shape processing lens holder to a convex surface of a spectacle lens, using a support unit that supports the spectacle lens with two alignment reference marks for identifying a distance portion design reference point formed on a concave surface, an imaging unit that images the alignment reference marks of the spectacle lens supported by the support unit from a convex surface side of the spectacle lens, and a monitor that displays an image, the block process including:

a process of causing the support unit to support the spectacle lens;

a process of obtaining expected imaged positions of the alignment reference marks imaged by the imaging unit, using information regarding the spectacle lens, when a posture of the spectacle lens supported by the support unit becomes a reference posture suitable for mounting the lens holder;

a process of performing position adjustment of the spectacle lens to position images of the alignment reference marks actually imaged by the imaging unit to images of index marks indicating the expected imaged positions, while displaying the images of the index marks and the images of the alignment reference marks; and a process of mounting the lens holder to the convex surface of the spectacle lens that has undergone the position adjustment.

According to a sixth aspect of the present invention, there is provided anon-transitory computer-readable recording medium storing a program for causing a computer to execute processing of identifying a position where two alignment reference marks are viewed, when a spectacle lens with the two alignment reference marks for identifying a distance portion design reference point formed on a concave surface are viewed from a convex surface side of the spectacle lens, the program for causing the computer to execute processing including:

a step A of calculating coordinate values indicating positions of the two alignment reference marks, in a coordinate system where a holder mounting center position that serves as a reference for mounting a lens shape processing lens holder to a convex surface of the spectacle lens is an origin; and a step B of obtaining, by ray tracing, positions where a ray passing through the position of one alignment reference mark and a ray passing through the position of the other alignment reference mark, of rays passing through the positions of the two alignment reference marks, the positions being indicated by the coordinate values calculated in the coordinate system, intersect with the convex surface of the spectacle lens.

According to a seventh aspect of the present invention, there is provided the non-transitory computer-readable recording medium storing a program according to the sixth aspect, wherein the step A includes a step of taking in the coordinate values indicating the positions of the two alignment reference marks, in a coordinate system different from the coordinate system where the holder mounting center position is the origin, and a step of performing coordinate conversion of the different coordinate system into the coordinate system where the holding mounting center position is the origin, and calculates the coordinate values indicating the positions of the two alignment reference marks in the coordinate system after the coordinate conversion.

Advantageous Effects of Invention

According to the present invention, a lens shape processing lens holder can be highly precisely mounted to a convex surface of a spectacle lens with alignment reference marks formed on a concave surface. Accordingly, the lens shape processing of the spectacle lens can be precisely performed.

DESCRIPTION OF EMBODIMENTS

Hereinafter, an embodiment of the present invention will be described in detail with reference to the drawings.

In the embodiment of the present invention, description will be given in the following order.

1. Schematic Configuration of Block Device
2. Mechanical Configuration of Block Device
3. Configuration of Spectacle Lens
4. Configuration of Lens Holder
5. Spectacle Lens Manufacturing Method
6. Effects according to Embodiment
7. Modifications

1. Schematic Configuration of Block Device

Figure 1:
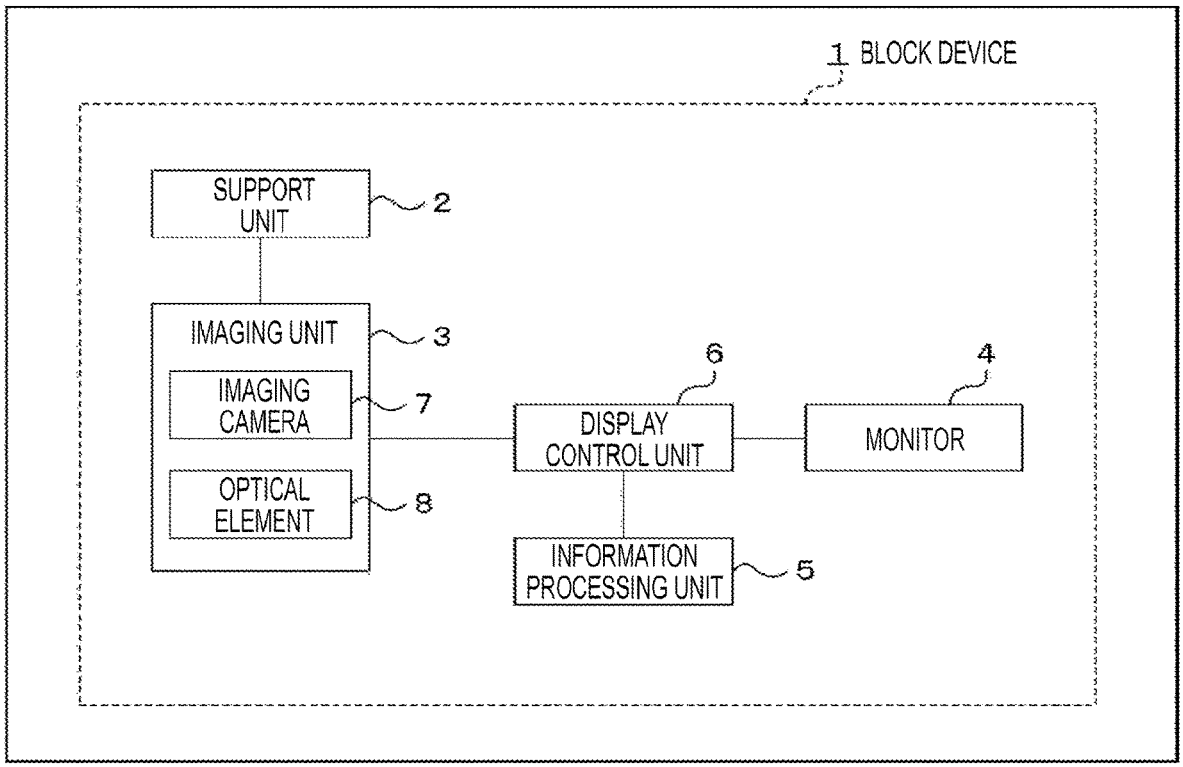
FIG. 1 is a schematic configuration diagram of a block device according to an embodiment of the present invention.

FIG. 1 is a schematic configuration diagram of a block device according to an embodiment of the present invention.

The illustrated block device 1 is used to mount a lens shape processing lens holder to a convex surface of a spectacle lens (uncut lens) before lens shape processing. The block device 1 roughly includes a support unit 2 that supports the spectacle lens, an imaging unit 3 that images the spectacle lens, a monitor 4 that displays an image, an information processing unit 5 that performs information processing upon startup of a program, and a display control unit 6 that controls display of the image by the monitor 4.

The support unit 2 supports the spectacle lens in a position adjustable manner. To be specific, the support unit 2 receives the convex surface of the spectacle lens at three points from below to support the spectacle lens. In this support state, the spectacle lens is placed on the support unit 2 by its own weight. Therefore, an operator can adjust (roughly adjust or finely adjust) the position of the lens by lightly touching the spectacle lens.

The imaging unit 3 images alignment reference marks on the spectacle lens supported by the support unit 2 from a convex surface side of the spectacle lens. The imaging unit 3 includes an imaging camera 7 and an optical element 8. The imaging camera 7 is configured from a charged coupled device (CCD) camera, a complementary metal oxide semiconductor (CMOS) camera, or the like. The optical element 8 is configured from a lens, a mirror, a diaphragm, and the like. Note that, as an imaging light source, a special light source may be equipped in the block device 1, or an illumination (a fluorescent lamp or the like) installed on a ceiling portion of a manufacturing site may be substituted.

The monitor 4 displays various images. The monitor 4 can be configured from a liquid crystal display monitor, or the like. Image data displayed on the monitor 4 is input from the display control unit 6. However, the image imaged by the imaging unit 3 can be directly input from the imaging unit 3 to the monitor 4 without being relayed through the display control unit 6.

The information processing unit 5 obtains expected imaged positions of the alignment reference marks imaged by the imaging unit 3 when a posture of the spectacle lens supported by the support unit 2 becomes a reference posture (details will be described below) suitable for mounting the lens, using information regarding the spectacle lens. Specific processing content by the information processing unit 5 will be described below.

The display control unit 6 displays images of index marks that indicate the expected imaged positions obtained in the information processing unit 5 and images of the alignment reference marks actually imaged by the imaging unit 3 on the monitor 4. How the marks are specifically displayed on the screen of the monitor 4 will be described below.

2. Mechanical Configuration of Block Device

Figure 2:
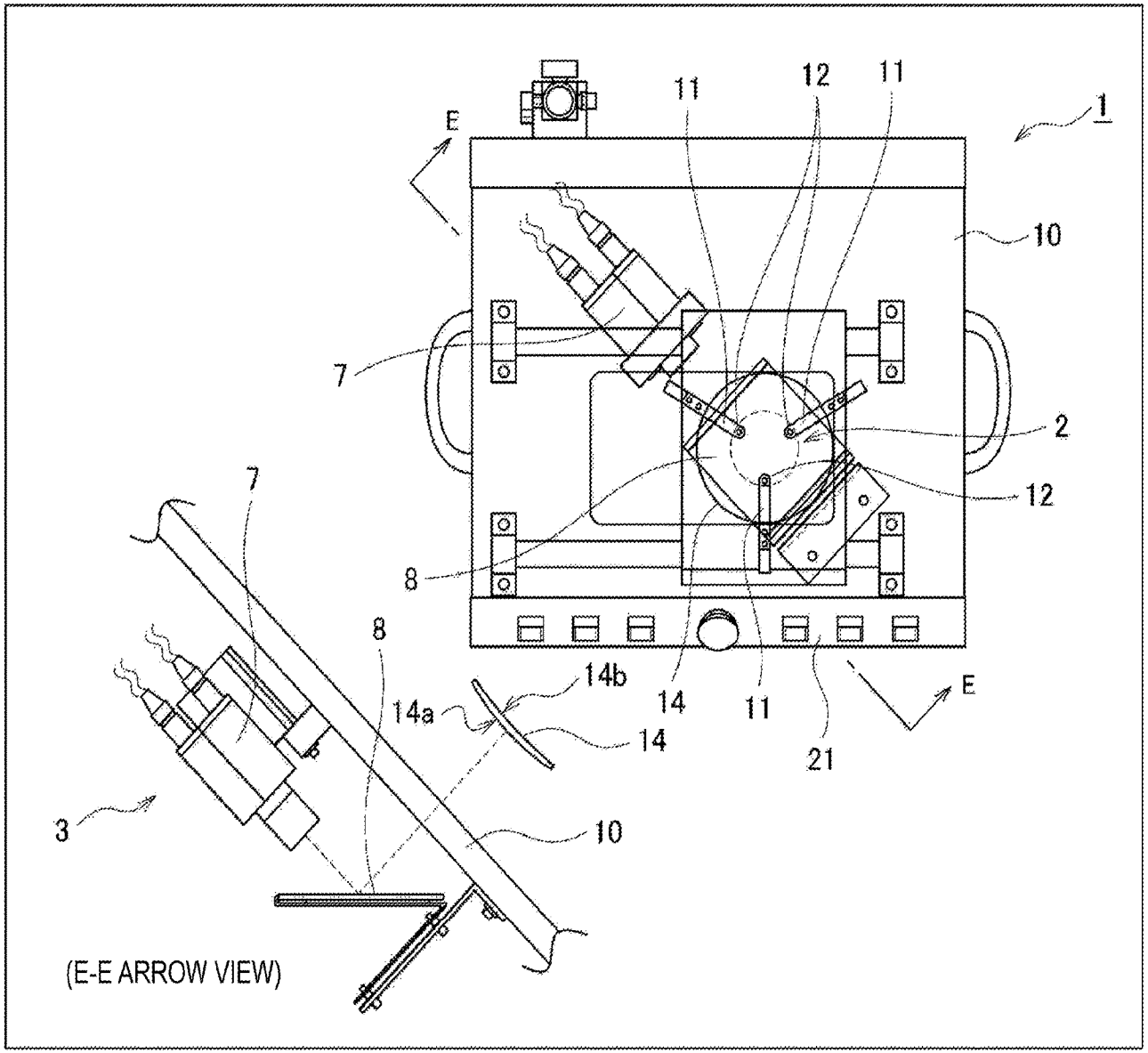
FIG. 2 is a diagram for describing a mechanical configuration of the block device according to the embodiment of the present invention (No. 1).
Figure 3:
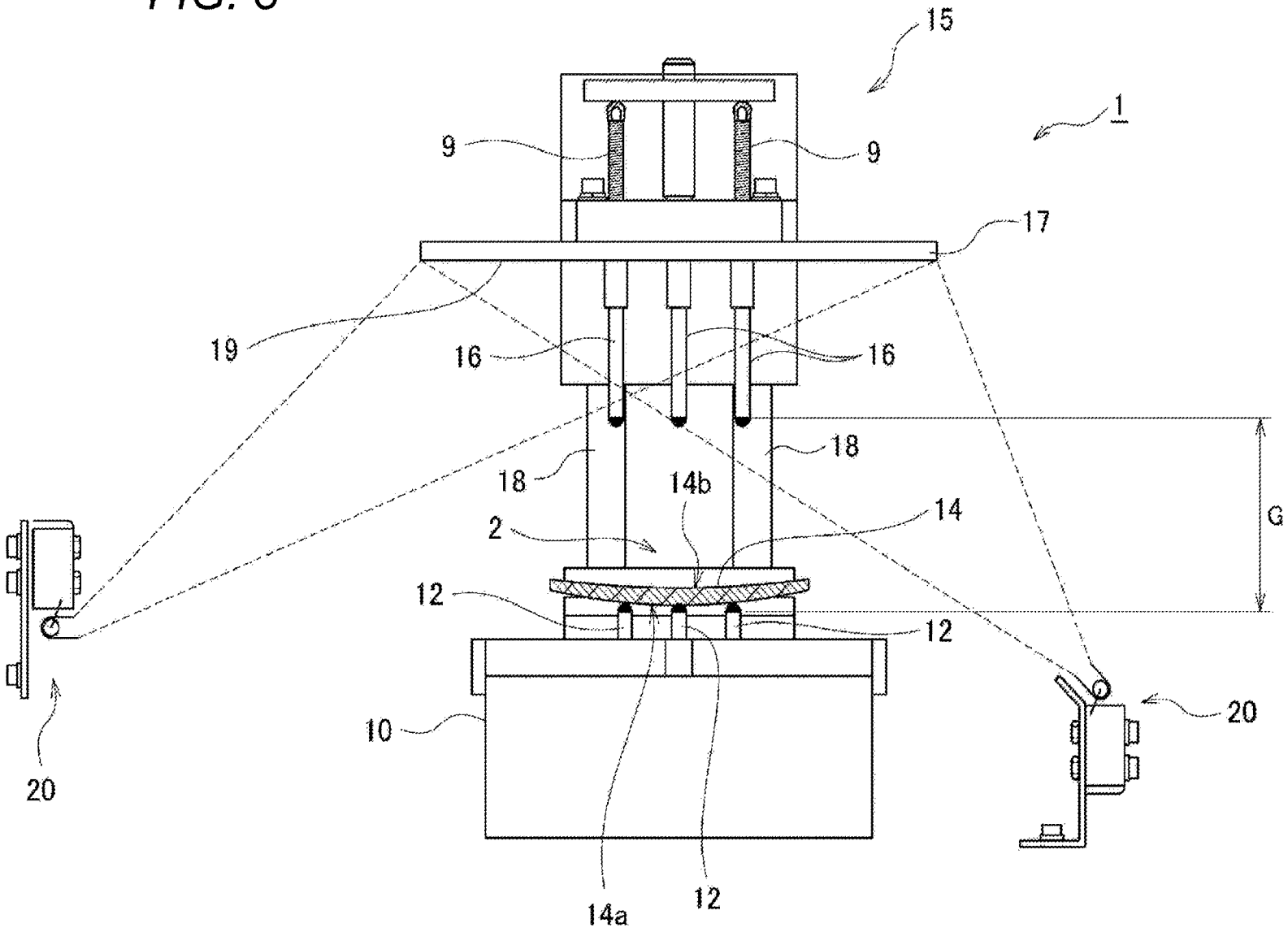
FIG. 3 is a diagram for describing a mechanical configuration of the block device according to the embodiment of the present invention (No. 2).

FIGS. 2 and 3 are diagrams for describing a mechanical configuration of a block device according to an embodiment of the present invention. FIG. 2 illustrates a plan view (including an E-E arrow view) of the block device, and FIG. 3 illustrates a side view of the block device.

The illustrated block device 1 is configured based on a frame 10. In the block device 1, the support unit 2 is configured from three support arms 11 provided on upper surface portions of the frame 10. Support pins 12 are provided on one ends of the respective support arms 11. The support pins 12 are arranged in a state of vertically standing to protrude from the upper surface portions of the frame 10. These support pins 12 receive a convex surface 14*a* of a spectacle lens 14 at three points and support the spectacle lens 14. The respective support pins 12 are arranged in a state of being positioned on vertexes of a right triangle in plan view. Further, upper ends of the respective support pins 12 are arranged at the same height in the vertical direction, and portions being in contact with the spectacle lens 14 are made round in a semi-spherical manner.

Meanwhile, a gimbal-type lens clamp mechanism 15 is arranged above the support unit 2. The lens clamp mechanism 15 is provided with three clamp pins 16. The three clamp pins 16 are arranged in a state of facing the above-described three support pins 12 in a one-on-one relationship. The lens clamp mechanism 15 presses the spectacle lens 14, which is supported by the three support pins 12, with the three clamp pins 16 from above, thereby to let the spectacle lens 14 put between the support pins 12 and the clamp pins 16 and clamps the spectacle lens 14.

The lens clamp mechanism 15 includes a lift table 17 movably provided in the vertical direction. The lift table 17 moves up and down along two lift shafts 18 by being driven by a drive source (for example, a motor, not illustrated). A lower surface of the lift table 17 configures a reflection surface 19 that reflects light. The reflection surface 19 reflects illumination light emitted from a pair of lighting equipment 20 toward the spectacle lens 14. The dotted lines in FIG. 3 illustrate optical paths of the illumination light.

A gimbal ring (not illustrated) having two perpendicular axes is attached to the lift table 17, and the three clamp pins 16 are supported by the gimbal ring. The respective clamp pins 16 are energized downward by corresponding spring members 9. The lift table 17 is usually retracted upward, and performs a lowering operation when clamping the spectacle lens 14. The lowering operation of the lift table 17 is executed by the operator who operates a button on a control panel 21 provided on a front portion of the frame 10. In a state where the lift table 17 is retracted upward, a clearance G necessary to insert and remove the spectacle lens 14 is secured between the support pins 12 and the clamp pins 16.

The imaging camera 7 and the optical element 8 are arranged inside the frame 10. The imaging camera 7 is configured from a CCD camera, as an example. The optical element 8 is configured from a total reflection mirror, as an example. The imaging camera 7 is horizontally attached to an upper plate portion of the frame 10. The imaging camera 7 images an optical image (including the alignment reference marks) of the spectacle lens 14, the optical image being reflected at the optical element 8. A reflection surface of the optical element 8 is arranged with an inclination of 45 degrees with respect to an optical axis of the imaging camera 7. Note that the number of the optical elements that configures an optical system of the imaging unit 3 may be two or more. Further, the camera and the optical element may be integrally configured.

3. Configuration of Spectacle Lens

Figure 4:
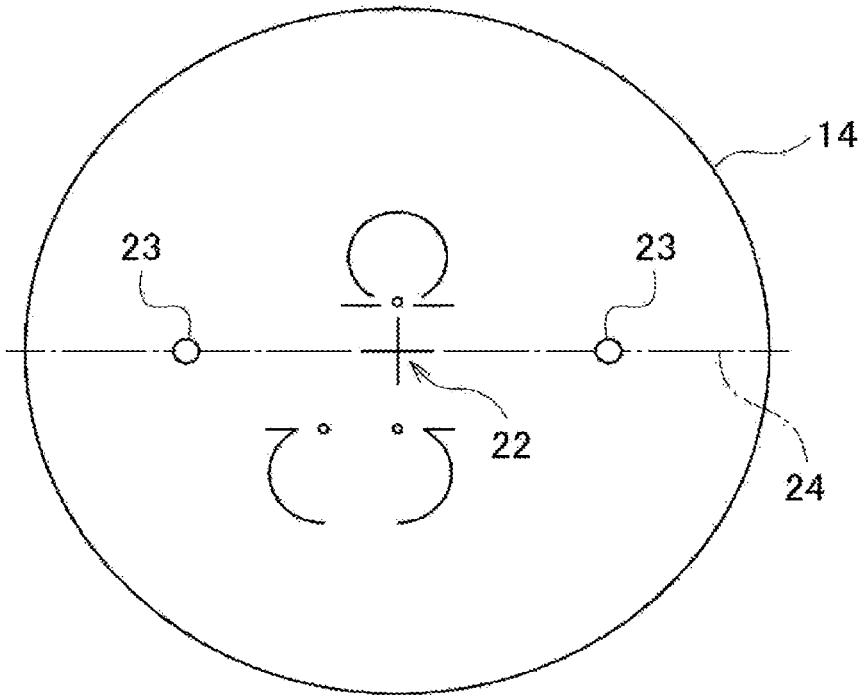
FIG. 4 is a front view illustrating a configuration of a spectacle lens (uncut lens) before lens shape processing.

FIG. 4 is a front view illustrating a configuration of the spectacle lens (uncut lens) before lens shape processing.

The illustrated spectacle lens 14 is a progressive power lens that is one of aspherical lenses. The spectacle lens 14 is provided with two alignment reference marks 23 for identifying design reference point (distance portion design reference point) 22 defined in the JIS standard (JIS T 7330). This spectacle lens 14 is a progressive power lens in which the convex surface 14*a* is a spherical surface and a concave surface 14*b* is an aspherical surface (progressive surface). Therefore, the alignment reference marks 23 are formed on the concave surface 14*b* of the spectacle lens 14, which can be finished to have a desired aspherical surface shape by polishing processing.

The respective alignment reference marks 23 are affixed to positions with equal distances from the design reference point 22 to the right and left (in a horizontal axis direction). Therefore, in the spectacle lens 14, a middle point between the two alignment reference marks 23 can be identified as the design reference point 22, on a horizontal reference line 24 that passes through a center (when the shape of the alignment reference mark is a circle as illustrated in FIG. 4, the center of the circle) of the two alignment reference marks 23.

When the alignment reference marks 23 are affixed to the progressive power lens, the alignment reference marks 23 are required to be "displayed in a way of not easily disappearing" in the JIS standard (JIS T 7315). Further, the alignment reference marks 23 remains on the spectacle lens in a stage where the lens shape processing is completed, and thus the alignment reference marks 23 are affixed in a way of not standing out in appearance (for example, by a method of engraving the marks with a laser). Therefore, the alignment reference marks 23 are also called "hidden marks". Note that the marks called hidden marks include other marks (marks that display a name of a manufacturer, a type, and a power of the lens) affixed on the spectacle lens by a similar method, in addition to the alignment reference marks 23.

Note that, in FIG. 4, a mark indicating a portion where a distance power is measured, a mark indicating a portion where a near power is measured, a mark indicating a distance eye point, and the like are illustrated, in addition to the two alignment reference marks 23. However, only the hidden marks including the alignment reference marks 23 are affixed to the actual spectacle lens 14.

4. Configuration of Lens Holder

Figure 5A:
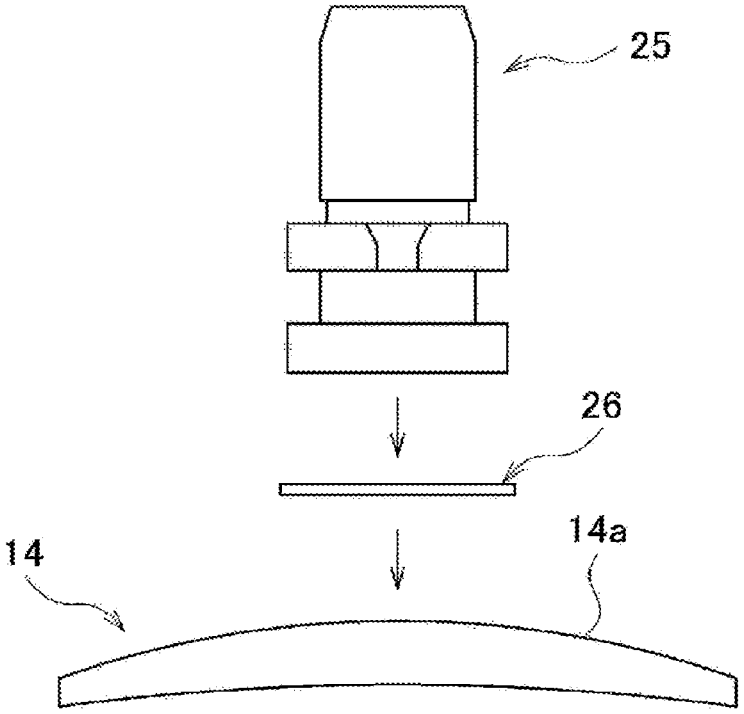
FIGS. 5A and 5B are diagrams for describing a configuration of a lens shape processing lens holder.
Figure 5B:
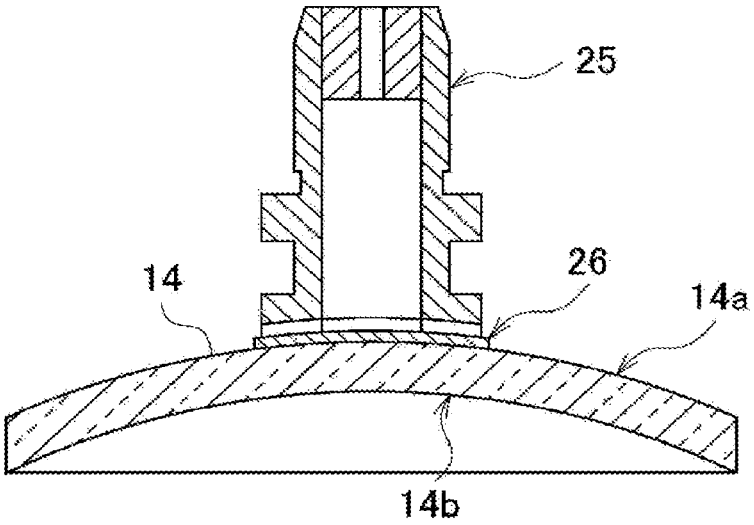

FIGS. 5A and 5B are diagrams for describing a configuration of a lens shape processing lens holder.

The illustrated lens holder 25 is used to set the spectacle lens 14 to a lens shape processor (not illustrated). A main body of the lens holder 25 is configured from metal such as stainless steel or a resin. Further, the lens holder 25 is formed into a cylindrical shape with a jaw to conform to the specification of the lens shape processor. One end surface of the lens holder 25 is formed into a shape of a concave surface corresponding to the convex surface 14*a* of the spectacle lens 14, and the concave surface is stuck to the spectacle lens 14 with a seal member 26. As the seal member 26, a double-sided adhesive sheet having adequate elasticity is used.

Here, the reference posture of the spectacle lens 14 will be described. The reference posture of the spectacle lens 14 refers to a posture of when the posture of the spectacle lens 14 supported by the support unit 2 becomes a state suitable for mounting the lens holder 25, when the lens holder 25 is mounted to the convex surface 14*a* of the spectacle lens 14 using the block device 1. To be more specific, the reference posture of the spectacle lens 14 refers to a state in which a normal vector of a center position (holder mounting center position) where the lens holder 25 should be mounted, on the convex surface 14*a* of the spectacle lens 14, becomes parallel to an optical axis of the optical system of the imaging unit 3, and the two alignment reference marks 23 become a horizontal state (Y coordinate values of the respective alignment reference marks 23 are equal). In the present embodiment, the posture of when the holder mounting center position of the spectacle lens 14 faces directly downward in the vertical direction, under the state where the spectacle lens 14 is supported by the support unit 2, is the reference posture of the spectacle lens 14. The block device 1 is configured such that the posture of the spectacle lens 14 in the support unit 2 becomes the reference posture, when the images of the alignment reference marks 23 are positioned to images of index marks 27 described below on the monitor 4.

5. Spectacle Lens Manufacturing Method

Next, a spectacle lens manufacturing method according to an embodiment of the present invention will be described.

Figure 6:
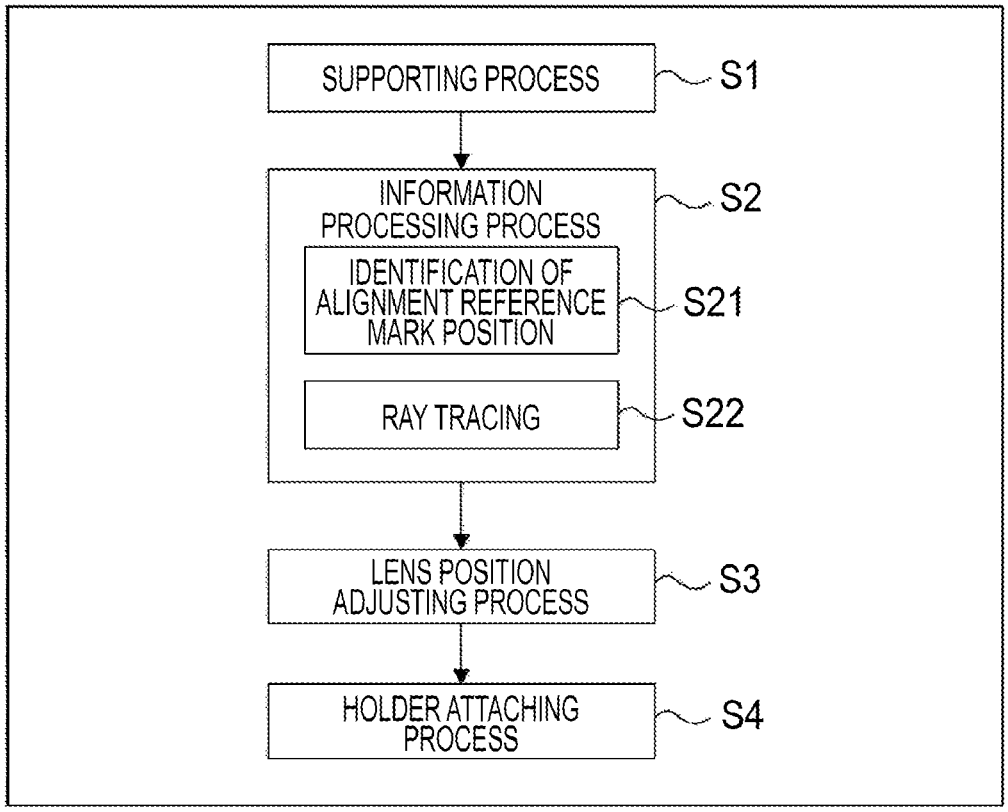
FIG. 6 is a process diagram for describing a spectacle lens manufacturing method according to an embodiment of the present invention.

The spectacle lens manufacturing method according to an embodiment of the present invention includes a block process of mounting the lens shape processing lens holder to the convex surface 14*a* of the spectacle lens 14, using the support unit 2, the imaging unit 3, and the monitor 4. In the block process, the lens shape processing lens holder 25 is mounted to the convex surface 14*a* of the spectacle lens 14 according to a procedure (process) illustrated in FIG. 6. Hereinafter, specific description will be given.

(Supporting Process: S1)

First, the spectacle lens 14 is supported by the support unit 2. To be specific, the spectacle lens 14 is placed on the three support pins 12. At this time, the convex surface 14*a* of the spectacle lens 14 faces downward. Accordingly, the spectacle lens 14 becomes a state in which the convex surface 14*a* is in contact with the three support pins 12, that is, the spectacle lens 14 is supported at three points. This process may be manually performed by the operator, or may be automatically performed using a lens supply device (not illustrated).

(Information Processing Process: S2)

Next, the expected imaged positions of the alignment reference marks 23 imaged by the imaging unit 3 when the posture of the spectacle lens 14 supported by the support unit 2 becomes the reference posture suitable for mounting the lens holder 25 are obtained using information regarding the spectacle lens 14. This process is performed by the information processing unit 5. To be specific, the information processing unit 5 obtains the expected imaged positions of the alignment reference marks 23 by performing processing of identifying the alignment reference mark positions, ray tracing processing, and the like, using the information regarding the spectacle lens 14. Processing content of the processing will be described below.

(Lens Position Adjusting Process: S3)

Next, position adjustment of the spectacle lens 14 is performed such that the images of the alignment reference marks 23 actually imaged by the imaging unit 3 are positioned to the images of the index marks that indicate the expected imaged positions while the images of the index marks and the images of the alignment reference marks 23 are displayed on the monitor 4.

Figure 7:
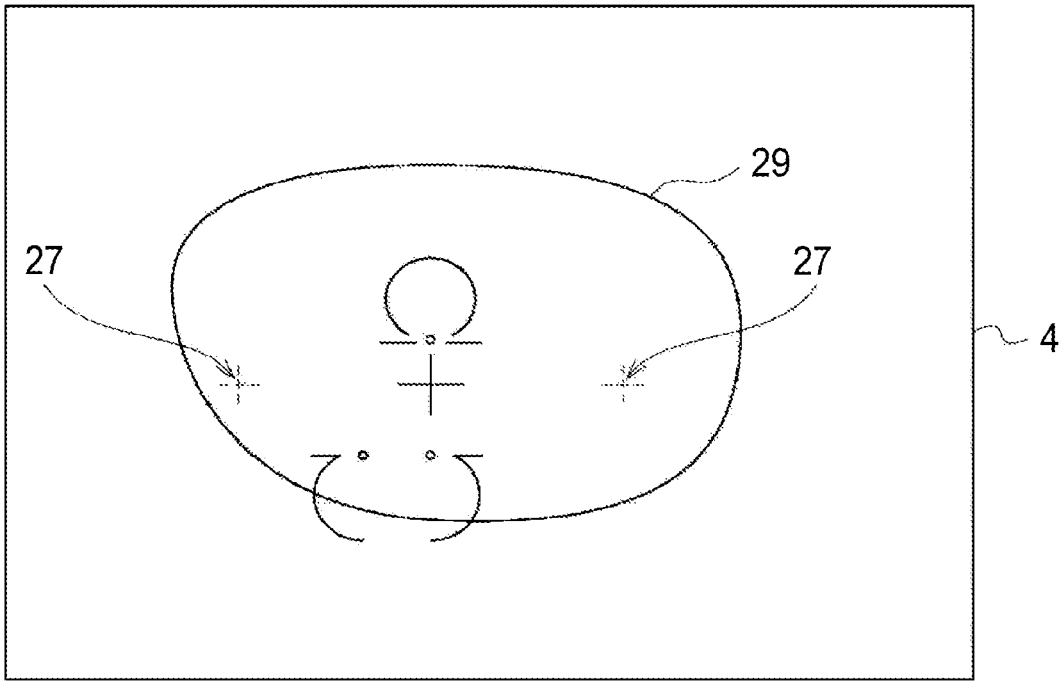
FIG. 7 is a diagram illustrating a state in which index marks indicating expected imaged positions of alignment reference marks are displayed on a screen of a monitor.

FIG. 7 is a diagram illustrating a state in which the index marks that indicate the expected imaged positions of the alignment reference marks are displayed on the screen of the monitor. The illustrated index marks 27 are displayed on the screen of the monitor 4 with dotted cross-shaped marks. The index marks 27 indicate the expected imaged positions of the alignment reference marks 23 imaged by the imaging unit 3 when the posture of the spectacle lens 14 supported by the support unit 2 becomes the reference posture. These expected imaged positions virtually illustrate positions of the alignment reference marks 23 that can be viewed from the imaging camera 7 when the spectacle lens 14 supported by the support unit 2 in the reference posture is imaged by the imaging camera 7, that is, positions where the alignment reference marks 23 should be arranged under the reference posture. Display positions of the index marks 27 on the screen of the monitor 4 are determined by the display control unit 6 based on the expected imaged positions of the alignment reference marks 23 obtained by the information processing unit 5, imaging magnification of the imaging unit 3, and the like. The shape of the index mark 27 may be any shape as long as the shape can uniquely identify the expected imaged position of the alignment reference mark on the screen of the monitor 4. Further, in FIG. 7, an expected external form line 29 that expects a lens external form after the lens shape processing is applied to the spectacle lens 14 is displayed together with the index marks 27.

Figure 8:
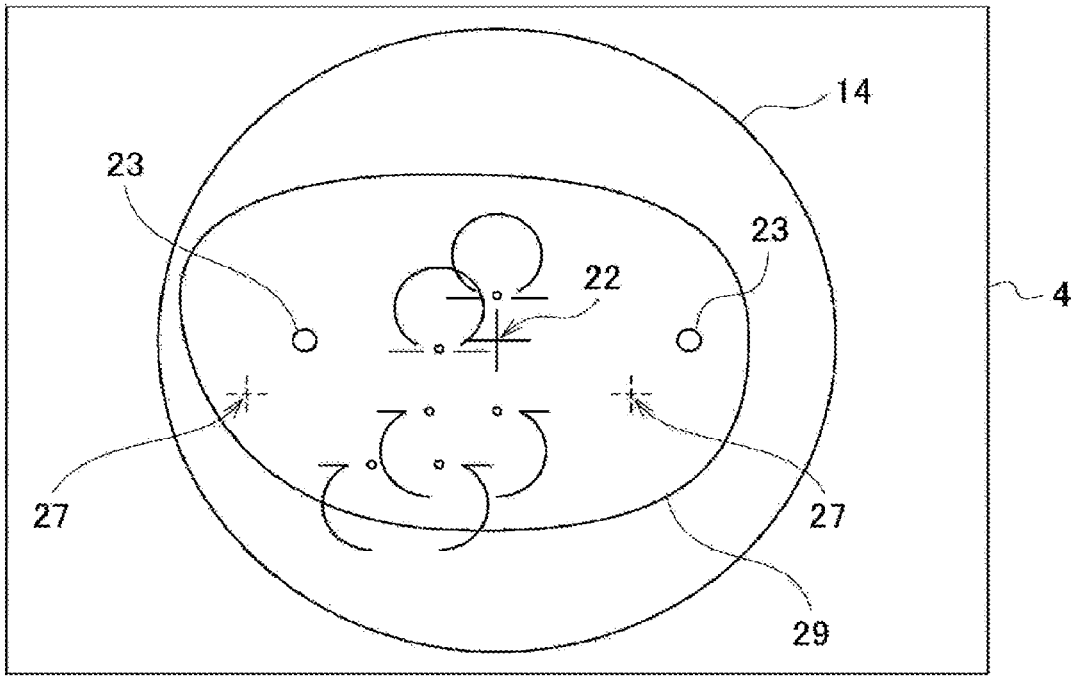
FIG. 8 is a diagram illustrating a state in which an image (including images of the alignment reference marks) of the spectacle lens obtained when the spectacle lens supported by a support unit is imaged by an imaging unit is displayed on the screen of the monitor.

FIG. 8 is a diagram illustrating a state in which the image of the spectacle lens 14 (including the images of the alignment reference marks 23) obtained when the spectacle lens supported by the support unit is imaged by the imaging unit is displayed on the screen of the monitor 4 together with the index marks 27 and the like.

In the stage where the spectacle lens 14 is placed on the support unit 2 in the supporting process S1, strict positioning is not performed, and thus the spectacle lens 14 is supported in a posture different from the reference posture. Therefore, the image data of the spectacle lens 14 imaged by the imaging unit 3 is taken by the display control unit 6 and displayed on the monitor 4, the images of the index marks 27 and the images of the alignment reference marks 23 deviate, as illustrated in FIG. 8.

Figure 9:
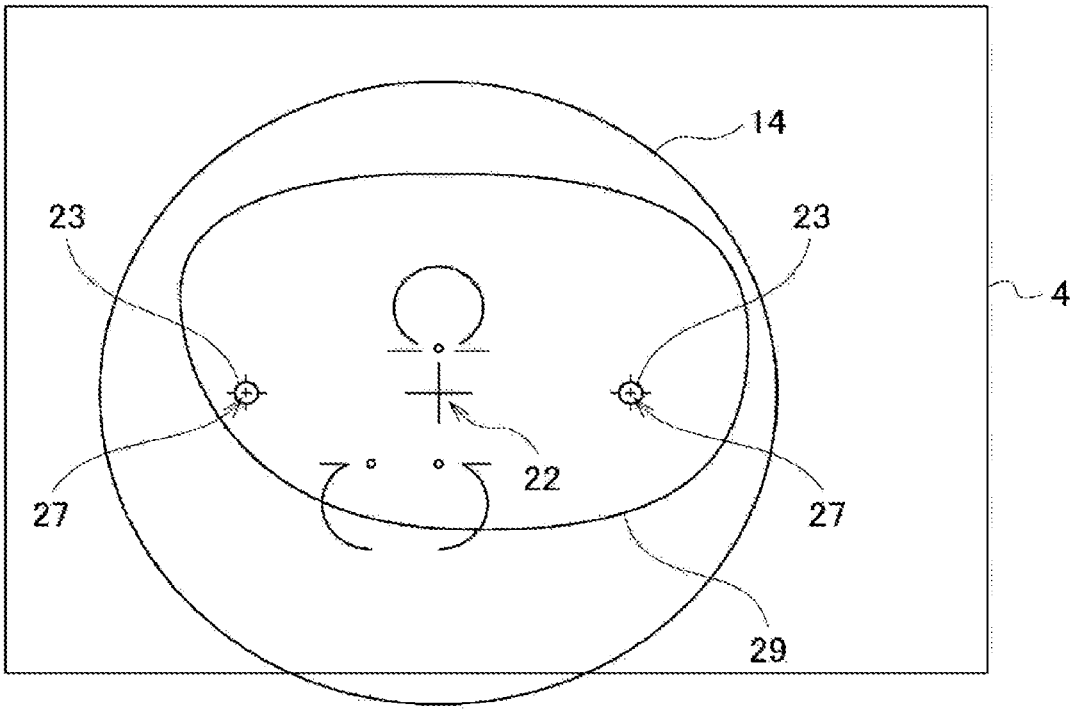
FIG. 9 is a diagram illustrating a state in which images of the alignment reference marks and images of the index marks are superimposed on the screen of the monitor.

In such a case, the operator lightly touches an edge of the spectacle lens 14 supported by the support unit 2 and slightly shifts the position (posture). If so, the images of the alignment reference marks 23 displayed on the screen of the monitor 4 are displaced according to the movement of the spectacle lens 14. At that time, the operator positions the images of the alignment reference marks 23 to the positions of the index marks 27 by adjusting (slightly adjusting) the position of the spectacle lens 14 while viewing the images of the index marks 27 and the images of the alignment reference marks 23 displayed on the screen of the monitor 4. Accordingly, the images and the alignment reference marks 23 and the images of the index marks 27 are superimposed on the screen of the monitor 4 as illustrated in FIG. 9. At this time, in the support unit 2, the spectacle lens 14 is supported in the reference posture.

(Holder Attaching Process: S4)

Next, the lens holder 25 is attached to the convex surface 14*a* of the spectacle lens 14 that has undergone the position adjusting. Attachment of the lens holder 25 is automatically performed by the block device 1 with a pressing operation of a predetermined button provided on the control panel 21. An operation procedure of the block device 1 at that time will be described below.

First, the lift table 17 starts the lowering operation upon drive of the lens clamp mechanism 15. Following that, at a state where the three clamp pins 16 come in contact with the concave surface 14*b* of the spectacle lens 14, and adequate contact pressure is obtained by energizing force of the spring member 9, the lowering operation of the lift table 17 is stopped. Accordingly, the spectacle lens 14 receives the contact pressure by the three clamp pins 16 and is clamped, while remaining supported by the three support pins 12 in the reference posture.

Next, the support unit 2 and the lens clamp mechanism 15 starts movement in the horizontal direction while clamping the spectacle lens 14. Then, at a stage where the spectacle lens 14 arrives at immediately above the lens holder 25 that stands by at a destination, the movement of the support unit 2 and the lens clamp mechanism 15 is stopped. At this time, positional relationships among the units of the block device 1 are adjusted in advance such that the holder mounting center position of the spectacle lens 14 is arranged on a central axis of the lens holder 25.

Next, a holder holding mechanism (not illustrated) included in the block device 1 rises. The holder holding mechanism rises while holding the lens holder 25 with the seal member 26 facing upward. Accordingly, the lens holder 25 is stuck to the convex surface 14*a* of the spectacle lens 14 with the seal member 26. Following that, the holder holding mechanism cancels the holding state of the lens holder 25 and is then lowered to the original position. Meanwhile, the lens clamp mechanism 15 rises up to the original height to be retracted from the spectacle lens 14. In this state, the operator takes out the spectacle lens 14 from the support unit 2. Accordingly, the spectacle lens 14 with the lens holder 25 mounted is obtained. Following that, the support unit 2 and the lens clamp mechanism 15 are horizontally moved to the original positions.

The operation of the block device 1 associated with attachment of the lens holder 25 is terminated.

After the series of the block process are completed, the lens shape processing of the spectacle lens 14 is performed in the next lens shape processing process. In the lens shape processing process, the spectacle lens 14 to which the lens holder 25 is mounted is set to the lens shape processor, and the lens shape processing is performed.

(Processing Content of Information Processing Process)

Next, processing content of the information processing process S2 will be described.

Typically, in a lens design program of an aspherical surface-type spectacle lens, the positions of the alignment reference marks, the positional relationship between the design reference point and the holder mounting center position, a curvature radius of the lens convex surface, a refractive index of the lens, and the like are set using a coordinate system (coordinate space), where a position different from the holder mounting center position of the spectacle lens, for example, a position where the optical axis, which passes through the design reference point of the spectacle lens, intersects with the convex surface of the spectacle lens (hereinafter, the position is referred to as "convex surface-side reference point") is an origin.

Therefore, in the information processing process S2, to obtain the expected imaged positions of the alignment reference marks 23, the following parameters are used in a case of a lens in which a convex surface side has a spherical surface and a concave surface side has a progressive surface, as an example of the information regarding the spectacle lens:

(a) X coordinate values of the alignment reference marks of when the convex surface-side reference point faces directly downward, (b) Y coordinate values of the alignment reference marks of when the convex surface-side reference point faces directly downward, (c) Z coordinate values of the alignment reference marks of when the convex surface-side reference point faces directly downward, (d) an X coordinate value of the holder mounting center position as viewed from the convex surface-side reference point, (e) a Y coordinate value of the holder mounting center position as viewed from the convex surface-side reference point, (f) a curve (dpt) or a curvature radius of the convex surface of the spectacle lens, and (g) a refractive index of the spectacle lens.

Among the parameters, as for the parameters (a) to (c), a layout (an eccentric amount of an optical center as needed) of the lens is obtained from data (shape and layout) regarding a prescribed power and a frame of a desired product (spectacle lens) by a higher custom-build calculation program than layout calculation, and three-dimensional coordinates are determined according to lens surface shape data by a calculation program for actually designing the lens. Further, as for the parameters (d) and (e), the positional relationship between the design reference point and a specified holder mounting center position is calculated in advance by layout calculation including calculation of the expected imaged positions. The parameter (f) is determined from a product and a prescribed power by the custom-build calculation program. The parameter (g) is determined from a product (a power of the spectacle lens or the like). The parameters (f) and (g) are held in a database, and are passed to the information processing unit 5 at the time of calculation of the expected imaged positions.

The information processing unit 5 is configured from a computer including hardware resources such as a memory such as a central processing unit (CPU), a read-only memory (ROM), and a random access memory (RAM), an input device, and an output device. The information processing unit 5 then reads a program stored in the ROM to the RAM and executes the program, using the hardware resources, thereby to perform processing of identifying the expected imaged positions of the alignment reference marks 23. To be specific, the information processing unit 5 performs processing of identifying positions where the two alignment reference marks 23 can be actually viewed from the imaging camera 7 when the spectacle lens 14 is viewed with the imaging camera 7 from the convex surface 14*a* side. Hereinafter, specific processing content will be described.

(Processing of Identifying Alignment Reference Mark Positions: S21)

First, in the information processing process S2, processing of identifying alignment reference mark positions S21 is performed. In this processing, after the parameters are taken in, the coordinate conversion is performed, so that the positions of the alignment reference marks 23 are identified. Hereinafter, specific description will be given.

First, the information processing unit 5 takes in the parameters. Taking in of the parameters in the information processing unit 5 may be performed by a data input using an input device, or may be performed by transfer of data (for example, reading out from the database) using a network.

Next, the information processing unit 5 performs the coordinate conversion in accordance with the state where the spectacle lens 14 is supported in the reference posture.

In the block device 1 according to the present embodiment, as described above, the posture of when the holder mounting center position of the spectacle lens 14 faces directly downward (below in the vertical direction) when the spectacle lens 14 is supported by the three support pins 12 is used as the reference posture. However, "the reference posture of the spectacle lens 14" may be changed depending on the specification of the block device. Therefore, the posture of when the holder mounting center position faces directly downward is not necessarily the reference posture.

In contrast, in the lens design program, the positions of the alignment reference marks and the like are set using a coordinate system where the convex surface-side reference point of when the convex surface-side reference point of the spectacle lens 14 faces directly downward is the origin, to be specific, the three-dimensional coordinate in which the convex surface-side reference point is the origin, and the optical axis of the spectacle lens, which passes through the origin, is a Z axis and two axes that are perpendicular at the origin with respect to the z axis are an X axis (horizontal axis) and a Y axis (vertical axis).

In this case, between the posture of when convex surface-side reference point of the spectacle lens 14 faces directly downward and the posture of when the holder mounting center position faces directly downward, the coordinate values where the alignment reference marks 23 in a specific coordinate system are different. Therefore, the information processing unit 5 performs coordinate conversion from the coordinate system where the convex surface-side reference point of the spectacle lens 14 is the origin into a coordinate system where the holder mounting center position of the spectacle lens 14 is the origin. Then, the positions of the alignment reference marks 23 are identified in the coordinate system after the coordinate conversion. Hereinafter, specific description will be given.

Figure 10A:
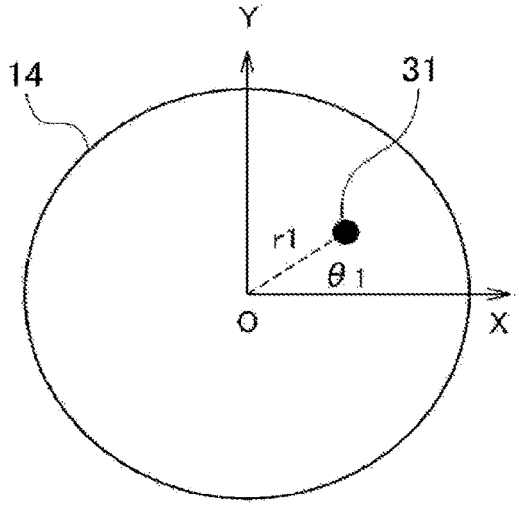
FIGS. 10A and 10B are diagrams for describing specific processing content of an information processing process (No. 1).

First, as illustrated in FIG. 10A, a direction ($\theta_1$) of a holder mounting center position 31 as viewed from an origin O is calculated in a coordinate system (hereinafter, called "coordinate system 1") where the convex surface-side reference point of the spectacle lens 14 is the origin O. The direction of the holder mounting center position 31 indicates which direction the holder mounting center position 31 exists as viewed from the origin O. Here, the direction of the holder mounting center position 31 is identified from an angle 1 made by a virtual straight line (illustrated by the dotted line in FIG. 10A) that connects the origin O and the holder mounting center position 31 and the X axis. Further, a distance $r_1$ between the origin O and the holder mounting center position 31 is calculated. The distance $r_1$ is used in a post-process. The parameters (a) to (e) are used in the calculation here.

Figure 10B:
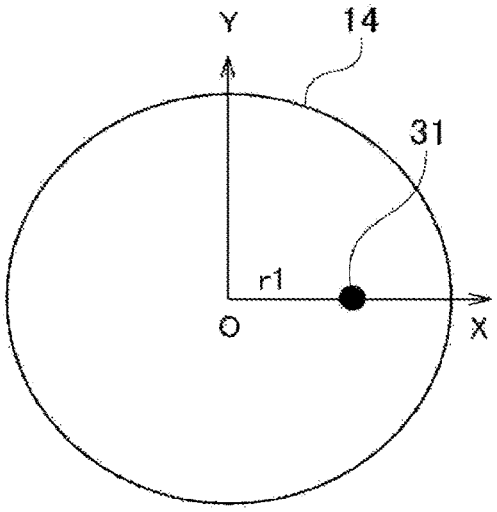

Next, as illustrated in FIG. 10B, the coordinate conversion is performed such that the X axis passes through the holder mounting center position 31 on the XY coordinate plane (hereinafter, the coordinate system after the coordinate conversion is called "coordinate system 2"). The coordinate conversion is performed by rotating relative positions of the X and Y axes, and the holder mounting center position 31, by the angle $\theta_1$ centering around the origin O. At this time, a relationship between one of coordinates of the alignment reference marks 23 in the coordinate system 1 and the position of the alignment reference mark 23 in the coordinate system 2 satisfies the following Mathematical Formula 1:

The relationship between one coordinate ($x_1$, $y_1$, $z_1$) of the alignment reference marks 23 in the coordinate system 1, and the position ($x'_1$, $y'_1$, $z'_1$) of the alignment reference mark 23 in the coordinate system 2 satisfies:

$$x'_1 = x_1 \times \cos(-\theta_1) - y_1 \times \sin(-\theta_1)$$

$$y'_1 = x_1 \times \sin(-\theta_1) - y_1 \times \cos(-\theta_1)$$

$$z'_1 = z_1 \qquad \text{[Mathematical Formula 1]}$$

Figure 11A:
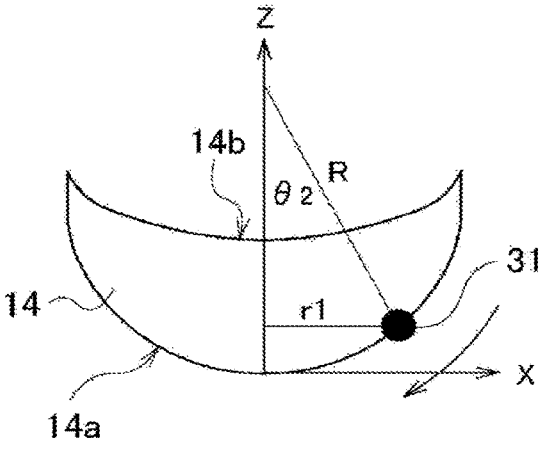
FIGS. 11A and 11B are diagrams for describing specific processing content of the information processing process (No. 2).

Next, the coordinate conversion is performed such that the holder mounting center position 31 becomes in the posture facing directly downward (the reference posture) in the support unit 2 (hereinafter, the coordinate system after the coordinate conversion is called "coordinate system 3"). To be specific, as illustrated in FIG. 11A, a rotation angle $\theta_2$ is obtained by the following formula (1) using the curvature radius (R) of the convex surface 14*a* of the spectacle lens 14 and the distance ($r_1$) calculated in the preprocess, and the coordinate conversion is performed using the rotation angle $\theta_2$. The parameter (f) is used in this coordinate conversion.

$$\theta_2 = \sin^{-1}(r_1/R) \qquad (1)$$

Figure 11B:
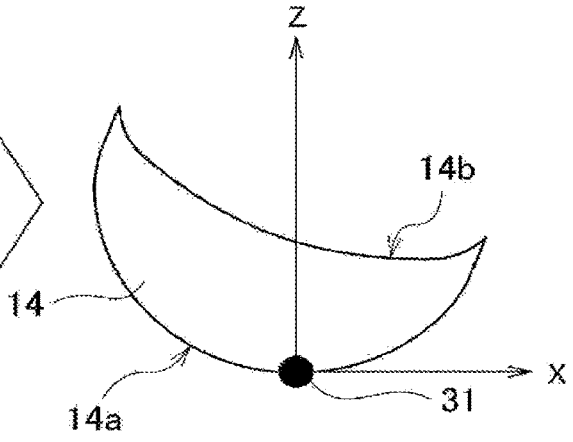

FIG. 11B illustrates a state after the coordinate conversion. In this state, the positions (coordinate values) of the two alignment reference marks 23 are identified according to the three-dimensional coordinates where the holder mounting center position 31 is the origin O. At this time, the positions of the alignment reference marks 23 in the coordinate system 3 satisfy the following Mathematical Formula 2:

The position ($x''_1$, $y''_1$, $z''_1$) of the alignment reference mark 23 in the coordinate system 3 satisfies:

$$x''_1 = x'_1 \times \cos(-\theta_2) + (z'_1 - R) \times \sin(-\theta_2)$$

$$y''_1 = y'_1$$

$$z''_1 = -x'_1 \times \sin(-\theta_2) + (z'_1 - R) \times \cos(-\theta_2) + R \qquad \text{[Mathematical Formula 2]}$$

At this point of time, the holder mounting center position 31 is in the posture facing directly downward. However, the X axis and the Y axis are rotated with respect to the coordinate system 1. Therefore, the X axis and the Y axis are rotated by an angle $-\theta_1$ centering around an origin O' to accord with the X axis and the Y axis of the coordinate system 1 (hereinafter, the coordinate system after the rotation is called "coordinate system 4"). At this time, the positions of the alignment reference marks 23 in the coordinate system 4 satisfy the following Mathematical Formula 3, and these positions are the alignment reference mark positions to be obtained.

The position ($x'''_1$, $y'''_1$, $z'''_1$) of the alignment reference mark 23 in the coordinate system 4 satisfies:

$$x'''_1 = x''_1 \times \cos\theta_1 - y''_1 \times \sin\theta_1$$

$$y'''_1 = x''_1 \times \sin\theta_1 - y''_1 \times \cos\theta_1$$

$$z'''_1 = Z''_1 \qquad \text{[Mathematical Formula 3]}$$

Note that the processing of the coordinate conversion is not necessarily required. To be specific, when the positions of the alignment reference marks 23 (X, Y, and Z coordinate values) of when the holder mounting center position 31 faces directly downward are calculated by the lens design program, and calculation results can be provided as parameters, the positions of the alignment reference marks 23 can be identified with the parameters under the reference posture. Therefore, the coordinate conversion is unnecessary.

(Ray Tracing Processing: S22)

Figure 12:
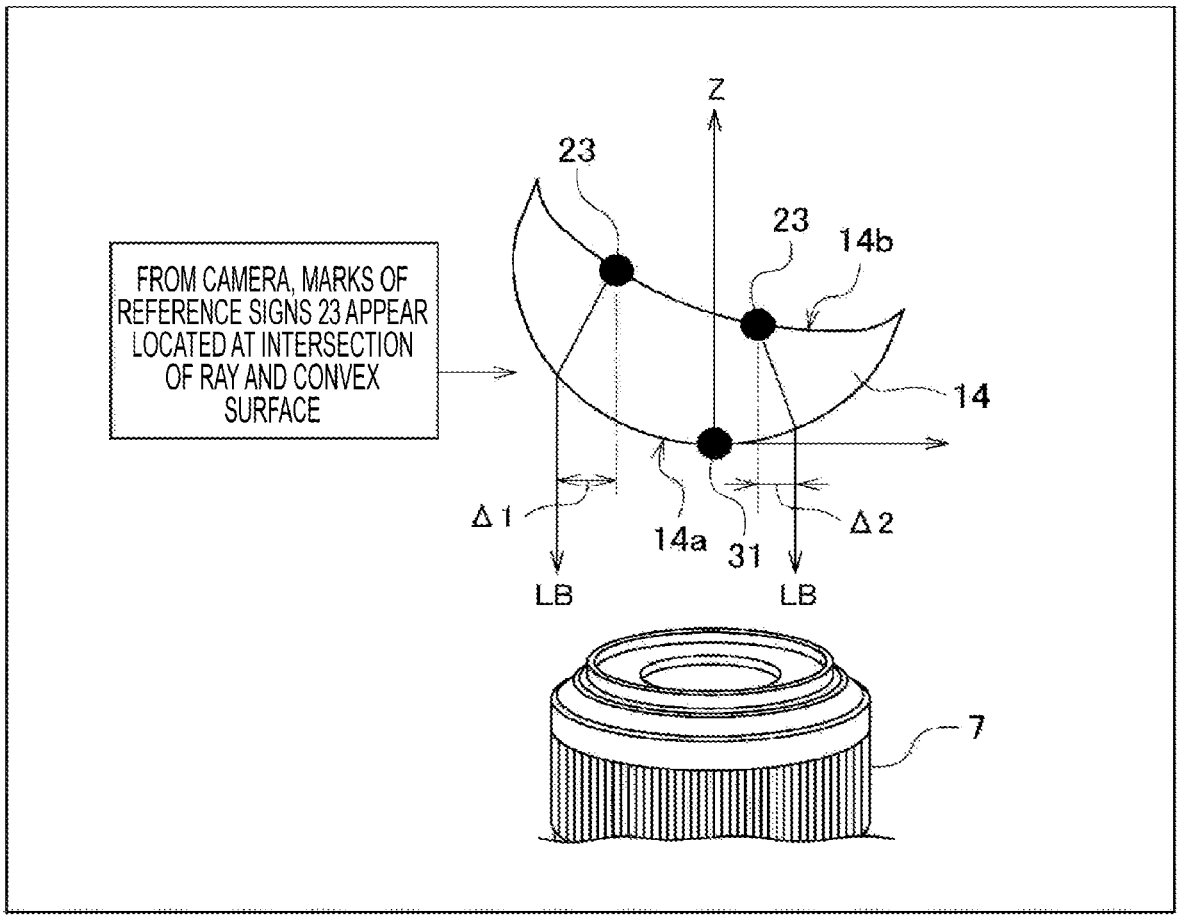
FIG. 12 is a diagram for describing specific processing content of the information processing process (No. 3).

Next, the information processing unit 5 performs ray tracing processing S22. In this processing, which positions the alignment reference marks 23 are viewed, when the two alignment reference marks 23 that have been identified by the coordinate conversion are viewed from the convex surface 14*a* side of the spectacle lens 14 with the imaging camera 7, are calculated by ray tracing. The above-described parameters (f) and (g) are used in this calculation. At that time, the positions of the alignment reference marks 23 imaged by the imaging camera 7 are influenced by the power of the spectacle lens 14. Therefore, in the calculation by ray tracing, the power of the spectacle lens 14 needs to be taken into account. Hereinafter, specific description will be given. Note that, in the present embodiment, the imaging camera 7 images the spectacle lens 14 through the optical element (mirror) 8. However, here, assume that the imaging camera 7 faces the convex surface 14*a* of the spectacle lens 14 in the Z axis direction, as illustrated in FIG. 12, for convenience of description.

Figure 13:
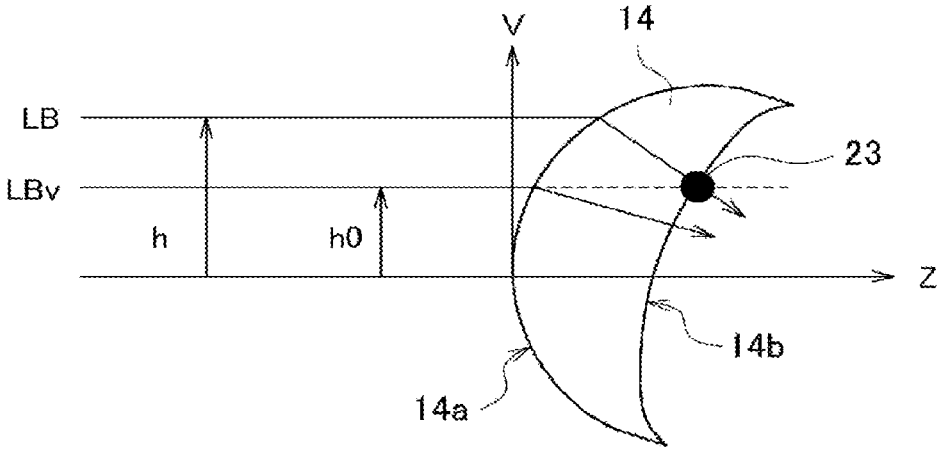
FIG. 13 is a diagram for describing specific processing content of the information processing process (No. 4).

First, in the block device 1, when the spectacle lens 14 is imaged by the imaging camera 7, rays enter from the concave surface 14*b* side of the spectacle lens 14, and the rays reach the imaging camera 7 through the spectacle lens 14. Therefore, in the calculation by ray tracing, positions (emitted positions of the rays) where the rays (illustrated by the reference sings LB in FIG. 12) that pass through (enter) the respective alignment reference marks 23 intersect with the convex surface 14*a*, among the rays reaching the imaging camera 7 through the spectacle lens 14, need to be obtained. However, for the purpose of calculation, the rays parallel to the Z axis enter the convex surface 14*a* of the spectacle lens 14, and the positions where the rays pass through the alignment reference marks 23 are calculated as "ray height", which is more simple calculation. Therefore, for the purpose of calculation, a ray LBv (hereinafter, referred to as "virtual ray") parallel to the Z axis is virtually assumed, as illustrated in FIG. 13, and a ray height h through which the ray passes through (enters) the alignment reference mark 23 is obtained using the Newton's method. To be specific, an intersection of the virtual ray and the convex surface 14*a* of the spectacle lens 14 is obtained, the normal vector of the convex surface 14*a* at the intersection is obtained, and an emitting direction of the virtual ray is calculated using the Snell's law. Meanwhile, a vector connecting the intersection of the virtual ray and the convex surface 14*a* of the spectacle lens 14 and the alignment reference mark 23 is an expected emitting direction of the virtual ray. Therefore, the ray height h is corrected to make a difference between the emitting directions 0, and a converged result is the ray height h to be obtained. A correction amount Δh of the ray height can be expressed by:

$$\Delta h = -f(f)/f'(h)$$

where a function expressing a difference between the emitting direction of the virtual ray, and the direction of the vector that connects the intersection of the virtual ray and the convex surface 14*a* of the spectacle lens 14 and the alignment reference mark 23 is f(h). The Z axis illustrated in FIG. 13 corresponds to the optical axis of the optical system of the imaging unit 3, which intersects with the convex surface 14*a* and the concave surface 14*b* of the spectacle lens 14, and the V axis corresponds to the direction in which the alignment reference mark 23 exists when the spectacle lens 14 is viewed in the Z axis direction. That is, the V axis is an axis that indicates the direction in which the alignment reference mark 23 exists, as viewed from the holder mounting center position 31 that is the coordinate origin on the XY coordinate plane. As for the initial position of the virtual ray LBv, the initial position may be set to, for example, a height (h0) that accords with the position of the alignment reference mark 23 recognized in the coordinate system where the holder mounting center position 31 is the origin.

Figure 14:
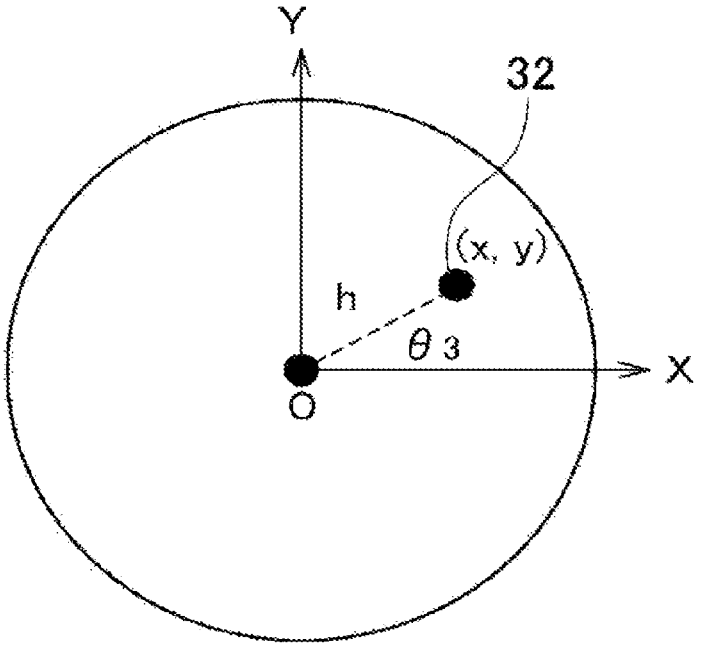
FIG. 14 is a diagram for describing specific processing content of the information processing process (No. 5).

Next, as illustrated in FIG. 14, the position of the ray LB that passes through the center position of the alignment reference mark 23 (in other words, the position of the ray LB that enters a portion of the concave surface 14*b* to which the alignment reference mark 23 is affixed) is obtained by calculation, on the XY coordinate plane of the three-dimensional coordinate space where the holder mounting center position 31 is the coordinate origin O. To be specific, the coordinate value (x, y) of the alignment reference mark 23 on the XY coordinate plane is obtained, based on the height h of the ray LB obtained in the ray tracing and the direction ($\theta_3$) of the alignment reference mark 23 as viewed from the holder mounting center position 31, by the following formula (2):

$$(x,y) = (h \cos\theta_3, h \sin\theta_3) \qquad (2)$$

Figure 15:
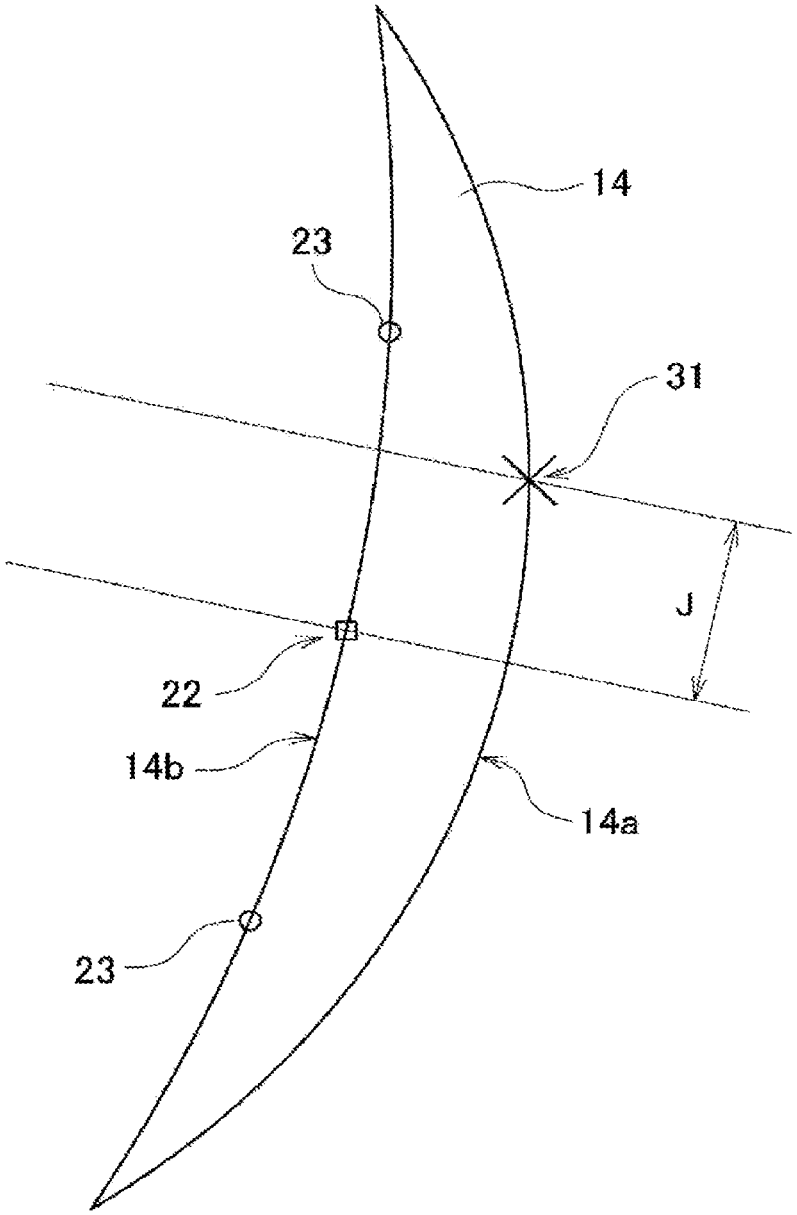
FIG. 15 is a diagram for describing specific processing content of the information processing process (No. 6).

The coordinate value (x, y) of the alignment reference mark 23 obtained as described above becomes a coordinate value that indicates an expected imaged position 32 (see FIG. 14) of the alignment reference mark 23 imaged by the imaging camera 7, when the holder mounting center position 31 faces directly downward and the spectacle lens 14 is supported by the support unit 2. The expected imaged position identified with the coordinate value is desirably obtained for each alignment reference mark 23. To be specific, it is desirable to individually obtain the expected imaged position of one alignment reference mark 23 and the expected imaged position of the other alignment reference mark 23, of the two alignment reference marks 23, according to an eccentric amount J (see FIG. 15) of the holder mounting center position 31 to the design reference point 22. The reason is that the positional relationship between the rays that pass through the respective alignment reference marks 23 does not become symmetrical due to the existence of the eccentric amount J. Hereinafter, specific description will be given.

First, if the holder mounting center position 31 is eccentric to the design reference point 22, the distance from the Z axis to the one alignment reference mark 23 and the distance from the Z axis to the other alignment reference mark 23 differ in the coordinate system where the holder mounting center position 31 is the origin O. Further, if there is the above eccentricity, the spectacle lens 14 is inclined on the whole in the coordinate system where the holder mounting center position 31 is the origin O. Therefore, when the inclination of the concave surface 14*b* using the XY coordinate plane as a reference is viewed, the inclination of the concave surface 14*b* of a portion to which the one alignment reference mark 23 is affixed and the inclination of the concave surface 14*b* of a portion to which the other alignment reference mark 23 is affixed differ. Therefore, a displacement amount Δ1 by which the ray that passes through the one alignment reference mark 23 is subject to the influence of refraction of the spectacle lens 14 and displaced, and a displacement amount Δ2 by which the ray that passes through the other alignment reference mark 23 is subject to the influence of refraction of the spectacle lens 14 and displaced differ, on the XY coordinate plane (see FIG. 12).

As a result, the positional relationship between the rays that pass through the respective alignment reference marks 23 does not become symmetrical to the Z axis. In that case, by performing the calculation of the ray tracing for each of the alignment reference marks 23, the expected imaged positions of the respective alignment reference marks 23 can be individually obtained according to the eccentric amount. Accordingly, even in a case where the concave surface 14*b* of the spectacle lens 14 have an inclination with respect to the XY coordinate plane where the holder mounting center position 31 is the origin O, the expected imaged positions of the respective alignment reference marks 23 can be accurately obtained, in consideration of the influence of refraction of the spectacle lens 14.

6. Effects According to Embodiment

According to the embodiment of the present invention, the spectacle lens 14 with the alignment reference marks 23 formed on the concave surface 14*b* is imaged by the imaging camera 7 from the convex surface 14*a* side. Therefore, the positions of the alignment reference marks 23 can be precisely identified without causing positional deviation due to a parallax and the like. Further, the expected imaged positions of the alignment reference marks 23 of when the posture of the spectacle lens 14 supported by the support unit 2 becomes the reference posture are obtained, and the expected imaged positions are displayed on the screen of the monitor 4 as the index marks 27. Therefore, the position of the spectacle lens 14 can be simply and highly precisely adjusted using the index marks 27. To be specific, the images of the index marks 27 and the images of the alignment reference marks 23 are simply positioned on the screen of the monitor 4, whereby the posture of the spectacle lens 14 can be set to the reference posture.

As a result, the lens shape processing lens holder 25 can be highly precisely mounted to the convex surface 14*a* of the spectacle lens 14 with the alignment reference marks 23 formed on the concave surface 14*b*.

Errors (PD deviations) of the holder mounting center position caused on the XY coordinate plane have been actually calculated in cases where an influence of the power due to the posture of the spectacle lens is taken into account and is not taken into account, about four samples in which the power, the eccentric amount, and the like of a plastic lens (FD 174) manufactured by HOYA Corporation are changed. Then, the results illustrated in Table 1 below have been obtained. In Table 1, "R" described on the right side of the sample number means a right eye lens, and "L" means a left eye lens. Further, the unit of the power is diopter, and the units of the eccentric amount and the error are millimeter (mm). Further, the values of the eccentric amount are described such that a value of when the holder mounting center position is eccentric inward (to a nose side) with respect to the design reference point is a negative value.

TABLE 1

| | | Power (diopter) | | | | Eccentric amount (mm) | | Error (mm) | |
|---|---|---|---|---|---|---|---|---|---|
| Sample No. | | Sph | Cyl | Axis | Add | Dx | Dy | x | y |
| Sample 1 | R | 2.00 | 0.00 | | 2.00 | −2.43 | 0.00 | −0.04 | 0.04 |
| | L | 2.00 | 0.00 | | 2.00 | −2.55 | 0.00 | −0.04 | 0.04 |
| Sample 2 | R | −2.00 | 0.00 | | 2.00 | −5.48 | 2.00 | 0.12 | 0.05 |
| | L | −2.00 | 0.00 | | 2.00 | −5.39 | 2.00 | −0.08 | 0.05 |
| Sample 3 | R | −4.00 | 0.00 | | 2.00 | −5.94 | 0.00 | −0.05 | 0.05 |
| | L | −4.00 | 0.00 | | 2.00 | −6.22 | 0.00 | −0.06 | 0.10 |
| Sample 4 | R | 4.00 | 0.00 | | 2.00 | −6.30 | 0.00 | −0.20 | 0.02 |
| | L | 4.00 | 0.00 | | 2.00 | −6.31 | 0.00 | −0.19 | 0.02 |

As can be viewed from Table 1, the maximum error (absolute value) in the X direction was 0.20 mm and the minimum error in the X direction was 0.04 mm, and the maximum error (absolute value) in the Y direction was 0.10 mm and the minimum error in the Y direction was 0.02 mm. These errors are changed depending on prescribed values such as the power and the eccentric amount of the lens, and the direction of an astigmatic axis. According to the present embodiment, the lens holder 25 can be amounted to the convex surface 14*a* of the spectacle lens 14 and the lens shape processing of the spectacle lens 14 can be performed without causing such errors.

7. Modifications

The technical scope of the present invention is not limited to the above-described embodiment, and include various changes and improvements within a scope where the special effects obtained from the configuration elements and its combinations of the invention can be arrived at.

For example, in the above embodiment, a case in which the lens holder is mounted to the progressive power spectacle lens has been described. However, the present invention can be widely applied to a case in which a lens holder is mounted to a convex surface of a spectacle lens with two alignment reference marks affixed to a concave surface of the spectacle lens. Therefore, the present invention can be applied to a case in which a lens holder is mounted to an aspherical lens, a spherical lens, and or the like other than the progressive power spectacle lens. Further, in a case of the progressive power spectacle lens, the progressive power spectacle lens can be of a type where only a concave surface is a progressive surface, a type where only a convex surface is a progressive surface, or a type where both of the concave and convex surfaces are progressive surfaces. Further, the present invention can be applied to an auto blocker that detects an alignment reference mark using an image processing device or the like, and automatically mounts the lens holder.

Further, either the supporting process S1 or the information processing process S2 included in the block process can be performed first as long as before the lens position adjusting process S3.

REFERENCE SIGNS LIST

1 Block device
2 Support unit
3 Imaging unit

4 Monitor
5 Information processing unit
6 Display control unit
7 Imaging camera
8 Optical element
14 Spectacle lens
14*a* Convex surface
14*b* Concave surface
22 Design reference point (distance design reference point)
23 Alignment reference mark
25 Lens holder
27 Index mark
31 Holder mounting center position
32 Expected imaged position

The invention claimed is:

1. A spectacle lens manufacturing method, using a block device, including a block process of mounting a lens holder to a convex surface of a spectacle lens, said blocking device comprising:

a support unit that supports the spectacle lens having two alignment reference marks formed on a concave surface, an imaging unit that images the alignment reference marks of the spectacle lens supported by the support unit from a convex surface side of the spectacle lens, and a monitor that displays an image, the block process comprising:

a process of causing the support unit to support the spectacle lens;

a process of obtaining expected imaged positions of the alignment reference marks imaged by the imaging unit, using information regarding the spectacle lens, when a posture of the spectacle lens supported by the support unit becomes a reference posture suitable for mounting the lens holder;

a process of performing position adjustment of the spectacle lens to position images of the alignment reference marks actually imaged by the imaging unit to images of index marks indicating the expected imaged positions, while displaying the images of the index marks and the images of the alignment reference marks; and a process of mounting the lens holder to the convex surface of the spectacle lens that has undergone the position adjustment.

2. The spectacle lens manufacturing method according to claim 1, wherein the alignment reference marks identify a distance portion design reference point of the spectacle lens.

3. The spectacle lens manufacturing method according to claim 2, wherein the information regarding the spectacle lens includes an eccentric amount of a center position where the lens holder is to be mounted, with respect to the distance portion design reference point.

4. The spectacle lens manufacturing method according to claim 3, wherein the expected imaged position of one alignment reference mark and the expected imaged position of the other alignment reference mark, of the two alignment reference marks, according to the eccentric amount are individually obtained in the process of obtaining expected imaged positions.

5. The spectacle lens manufacturing method according to claim 1, wherein the support unit supports the spectacle lens by receiving the convex surface of the spectacle lens at three points.

6. The spectacle lens manufacturing method according to claim 5, wherein the images of the index marks and the images of the alignment reference marks are displayed on the monitor, when the position of the spectacle lens supported by the support unit is adjusted.

7. The spectacle lens manufacturing method according to claim 1, wherein the reference posture of the spectacle lens is a state in that a normal vector of a center position where the lens holder is to be mounted, in the convex surface of the spectacle lens, becomes parallel to an optical axis of an optical system of the imaging unit, and that the two alignment reference marks become horizontal, and the posture of the spectacle lens in the support unit becomes the reference posture, when the images of the alignment reference marks are positioned to the images of the index marks on the monitor.

* * * * *